United States Patent [19]

Blaisdell

[11] Patent Number: 4,932,662

[45] Date of Patent: Jun. 12, 1990

[54] GOLF CLUB LIE ANGLE EVALUATION DEVICE

[75] Inventor: Gary Blaisdell, Phoenix, Ariz.

[73] Assignee: Henry-Griffitts, Inc., Hayden Lake, Id.

[21] Appl. No.: 390,065

[22] Filed: Aug. 7, 1989

[51] Int. Cl.[5] ..... A63B 69/36

[52] U.S. Cl. ..... 273/186 D; 273/77 R; 273/195 A; 273/176 J; 273/DIG. 14; 206/315.1; 33/508

[58] Field of Search ..... 273/186 D, 183 A, 183 D, 273/195 A, 77 R, 77 A, 186 R, 186 A, 176 J, DIG. 14; 33/508; 206/315.1

[56] References Cited

U.S. PATENT DOCUMENTS

| | | | |
|---|---|---|---|
| 1,000,982 | 8/1911 | Biddle | 273/174 |
| 3,486,755 | 12/1969 | Hodge | 273/167 A |
| 3,643,959 | 2/1972 | Cornell et al. | 273/185 X |

FOREIGN PATENT DOCUMENTS

| | | | |
|---|---|---|---|
| 233529 | 5/1925 | United Kingdom | 273/186 D |

OTHER PUBLICATIONS

Ralph Maltby's Book, Golf Club Design, Fitting Alteration and Repair, 1982 Edition, FIGS. 59-3, 59-4, 59-5, 59-6, 59-7-59-11.

*Primary Examiner*—George J. Marlo
*Attorney, Agent, or Firm*—James F. Duffy

[57] ABSTRACT

A means and method for testing the lie angle of a golf club to see if it is suitable for use by an individual golfer. A golf ball is situated on a support surface and addressed by a golfer holding a traial golf club whose lower surface has received in abradable coating. The golfer swings at the golf ball bringing the abradable coating on the golf club into contact with the surface originally supporting the ball. This contact causes abrasions in the abradable coating and the position of these abrasions indicates whether the lie angle of the particular club undergoining test is proper for the golfer.

17 Claims, 1 Drawing Sheet

GOLF CLUB LIE ANGLE EVALUATION DEVICE

BACKGROUND

1. Field of the Invention

The invention relates to methods and apparatus for determining the proper golf club lie angle to be utilized by an individual golfer.

2. Prior Art

The technique for playing a winning golf game may be summarized in one simple rule: hit the ball properly. As with similar, all-encompassing rules, this rule is easier stated than practiced. Golfers buy expensive clubs, take lessons, read books, and watch video recorded instructions all with the intention of learning to strike the ball properly. The prior art is replete with devices which will inform the golfer of where on the face of the club impact was made with the golf ball; or, whether the line of swing of the golf club was true with respect to the intended direction of flight of the golf ball. The prior art, however, has not adequately addressed the problem of the selection of the proper club lie angle to compliment the individual stance and stature of the golfer utilizing the club.

The lie angle of a golf club may be defined as that angle which the shaft of the club makes with the bottom surface of the golf club. Another way of picturing the lie angle would be to define it as the angle which the golf club shaft makes with a surface when the bottom edge of the golf club is resting on the surface. To strike a golf ball properly it is important that the ball be struck by the central area of the golf club and that the lower edge of the golf club be parallel to the surface on which the ball is resting at the instant of contact of ball and club. If the lie angle of a club is improper for the golfer using it, the bottom edge of the club will not lie parallel to the surface on which the golf ball is resting at the instant of impact between club and ball.

It is the intent of the invention to provide means and method whereby a golfer may select that golf club having the proper lie angle for his own use.

Summary of the Invention

An abradable coating is applied to the ground contacting surface of the head of a golf club being evaluated by a golfer. A supporting surface is provided for the golf ball. The supporting surface is also used to abrade the abradable coating applied to the golf club. The abrasion of this coating takes place when the golfer swings the golf club at the golf ball sitting on the surface. The contact of the golf club with the surface causes the coating to be abraded so as to indicate the points along the bottom edge of the golf club at which the club made contact with the support surface.

For convenience in handling and storing the apparatus, the supporting surface is coupled to a platform on which the golfer stands while testing the lie angle of the club. The platform may be folded to reduce its area. A further enhancement of the device makes the platform a part of a carrying case which, when opened, presents the platform, ready for use.

It has been discovered that a support surface which appears to be tactually soft enables the golfer to take a full swing without flinching. Such a tactually soft appearance is imparted to the surface when the surface is fabricated of a translucent material, for example, plastic.

The appearance of softness is further enhanced if the surface is made of a light blue or off white material.

The apparent reality of the testing procedure utilizing the apparatus is enhanced by setting the translucent support surface flush with the surface of an artificial grass rug or the like. By extending the artificial grass rug beyond the supporting surface, the golfer may stand on the artificial grass while carrying through with the steps of the methodology for determining the correct lie angle of the club he will use.

A DETAILED DESCRIPTION OF THE INVENTION

Figure 1:
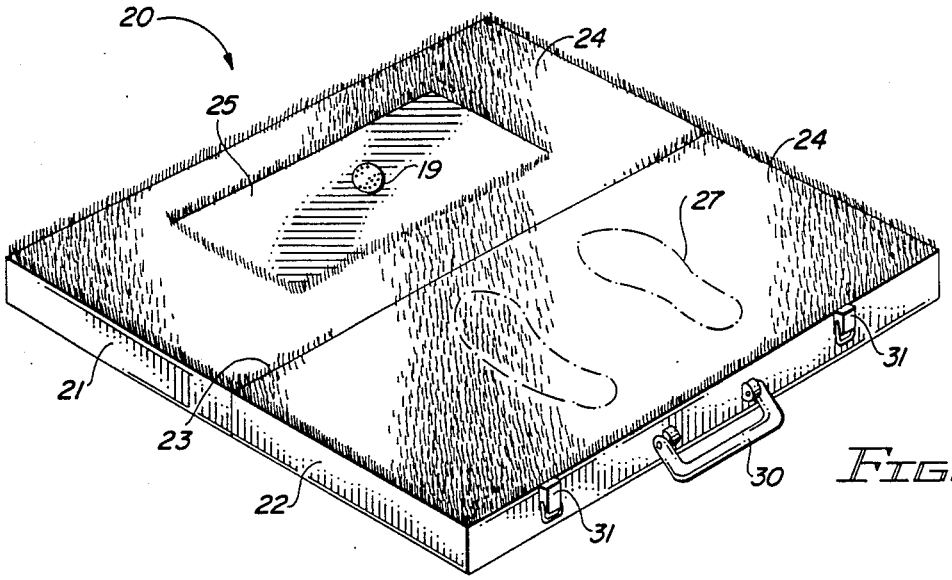
FIG. 1 illustrates a carrying case having therein a platform covered with artificial grass on which a golfer may stand while addressing a ball resting on what appears to the golfer to be a tactually soft support surface.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The invention is comprised of an abrading and supporting surface 25 on which a golf ball may be placed to thereafter be addressed and struck by the golf club handled by a golfer evaluating his golf club. In FIG. 1, support platform 25 is shown set generally flush with an artificial turf surface 24 following part of a platform housed within suitcase 20. The sides 21 and 22 of suitcase 20 raise the "turf" covered surface 24 slightly above the floor level. In addressing the ball 19, the golfer will position his feet on the artificial grass 24 in the manner generally indicated by phantom outlines 27.

Suitcase 20 is hinged along line 23 so as to be able to reduce the area occupied by turf covered platforms 24 and to provide easy means for transporting the apparatus. Latches, partially indicated at 31, maintain the case 20 in a closed position. Handle 30 may be utilized in transporting the case.

Figure 2:
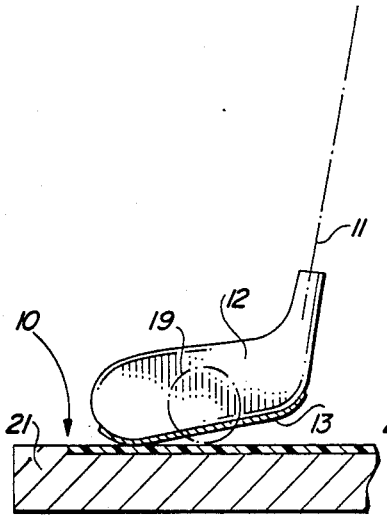
FIG. 2 illustrates a golf club having an improper lie angle for the golfer utilizing it.
Figure 4:
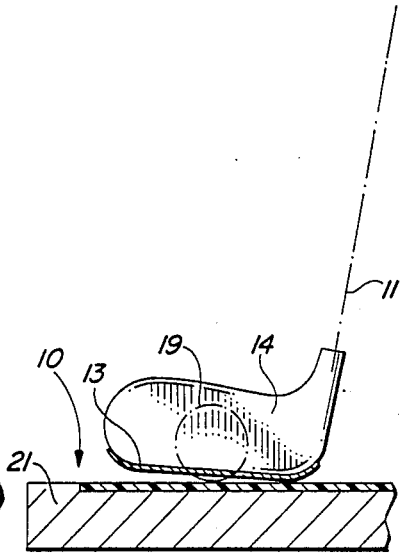
FIG. 4 is an illustration of a golf club having another, different, improper lie angle for the golfer utilizing the club.
Figure 6:
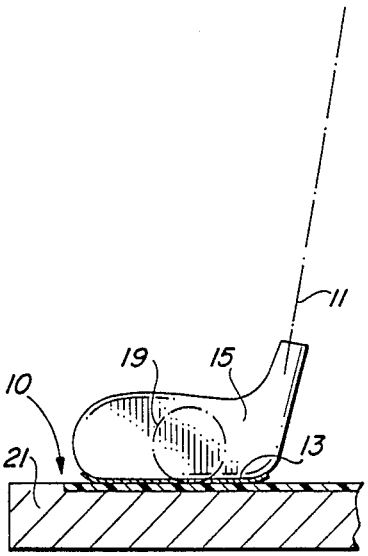
FIG. 6 illustrates a golf club having the proper lie angle for the golfer utilizing it.

FIGS. 2, 4 and 6 are related to each other in that golf club shafts 11, illustrated in each figure, are all drawn parallel to each other. Such an effect would generally result from the stance assumed by a golfer adressing ball 19, shown in phantom outline in FIGS. 2, 4 and 6 and using the individual golf clubs illustrated in those figures.

All of the necessary elements of invention 10 are shown in each of FIGS. 2, 4 and 6. These elements include a golf club 12, or 14, or 15; an abradable coating 13 applied to the base surface of each of those clubs; and a surface 25 utilized to support ball 19 as the golfer swings the golf club, 12, 14, or 15 in a normal manner bringing the abradable coating 13 into abrasive contact with support surface 25.

Figure 3:
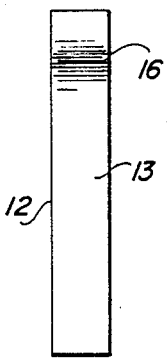
FIG. 3 illustrates that the golfer, utilizing the club of FIG. 2, will contact the ground on which the ball is supported at the toe end of the golf club.

In FIG. 2, the lie angle of golf club 12 is such that club 12 makes abrading contact with surface 25 in the vicinity of the toe of the club. As seen in the bottom view of club 12, FIG. 3, coating 13 appears abraded 16 as a result of its contact with surface 25. The position of the abrasions 16 indicates that the lie angle of the club is too great for the golfer. The golf club 12 and ball 19 stood in the relationship indicated in FIG. 2 at the instant of contact between golf club and ball.

Figure 5:
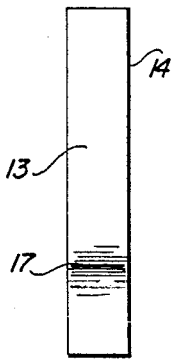
FIG. 5 illustrates that the golfer utilizing the club of FIG. 4 will strike the ball support surface with the heel of the club.

In FIG. 4 golf club 14 is shown at the instant of striking ball 19. Abradable coating 13 has contacted surface 25 so as to produce abrasion markings 17 on coating 13 at the base of club 14, as illustrated in FIG. 5. With the abrasions close to the heel of club 14 the indications are that the lie angle of this particular club is insufficient for proper usage of the club by the particular golfer. The relationship of ball and club at the instant of contact is illustrated in FIG. 4.

Figure 7:
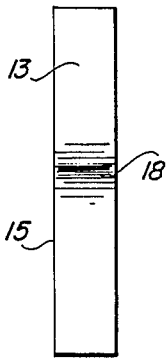
FIG. 7 indicates, by abrasions at the center of the base of the golf club head, that the bottom of the club was parallel to the support surface of the ball at the instant the ball and the club had made contact.

The relationship between a club 15 having a proper lie angle for the individual golfer and ball 19 is illustrated in FIG. 6. Abrasions 18 resulting from the contact of golf club 15 with surface 25 are shown in FIG. 7. Abrasions 18, at the central position of the base of club 15 indicate that the club is properly addressing the ball 19, as illustrated in FIG. 6. Centralized abrasions 18 are indications that the golf club 15 has the proper lie angle for the golfer testing the golf club.

In a presently preferred embodiment of the invention, abradable coating 13 is comprised, for example, of a strip of vinyl tape having an adhesive applied to one side of the tape to maintain it in position. Such vinyl tapes, and the like, are readily available at hardware and electrical supply stores. The tape is stretched across the base of the golf club as illustrated in FIGS. 2–7. This arrangement makes abradable coating 13 an essentially invisible and weightless addition to the club head.

Surface 25 which supports golf ball 20 is also the means whereby abradable coating 13 is, in fact, abraded. In preferred practice, surface 25 is set into the artificial grass rug 24 so as to coincide with the top extremities of the artificial grass surface. By fabricating surface 25 of a translucent material a psychological impression is built up in the mind of the golfer testing the golf club. The surface appears to be tactually soft and there is no fear which arises in the golfer as he swings the club at ball 19. This impression is enhanced by the presence of the artificial grass which shows hazily through the translucent material on surface 25. Enhancement may also be achieved by making the material of which surface 25 is fabricated of a light blue or off white cast. Under these conditions, the golfer will address the ball, follow through on her swing and cause the golf club to come into abrading contact with surface 25 causing the abrasive markings 16, 17, or 18 which indicate the relative merits of the lie angle of the club being tested by the golfer.

What has been described is a means and method for testing the lie angle of the golf club to see if it is suitable for use by an individual golfer. A golf ball is situated on a support surface and addressed by a golfer holding a trial golf club whose lower surface has received an abradable coating. The golfer swings at the golf ball bringing the abradable coating on the golf club into contact with the surface originally supporting the ball. This contact causes abrasions in the abradable coating and the position of these abrasions indicates whether the lie angle of the particular club undergoing test is proper for the golfer.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, That which is claimed is:

1. Apparatus for determining a golfer's proper golf club lie angle comprising:
   - a golf club including a head having a ground contacting surface to be evaluated by a golfer;
   - a removable abradable coating applied to said ground contacting surface of said head of said golf club and extending continuously from a first end located generally bellow the toe of said club head to a second end located generally below the heel of said club head; and
   - a translucent surface for supporting a golf ball and for abrading said abradable coating when a golfer swings said golf club at a golf ball supported on said surface said surface further including means for imparting a tactually soft appearance thereto.

2. The apparatus of claim 1 further comprising artificial turf on which a golfer can stand while addressing a golf ball supported on said surface, said surface being emplaced in said artificial turf.

3. The apparatus of claim 2 further comprising a carrying case having a platform to which said artificial turf and said surface are coupled and on which a golfer can stand while addressing a golf ball supported on said surface.

4. The apparatus of claim 3 wherein said carrying case has means for reducing the area occupied by said platform to facilitate transport and storage of said apparatus.

5. The apparatus of claim 4 wherein said means for reducing said platform's occupied area comprises folding means coupled to said platform.

6. The apparatus of claim 4 wherein said surface is a translucent surface said translucency imparting a tactually soft appearance to said surface.

7. The apparatus of claim 4 wherein said translucent surface is colored light blue as a means for imparting a tactually soft appearance to said surface.

8. The apparatus of claim 4 wherein said translucent surface is colored off white as a means for imparting a tactually soft appearance to said surface.

9. The apparatus of claim 1 having a platform to which said surface is coupled and on which a golfer can stand while addressing a golf ball supported on said surface.

10. The apparatus of claim 9 further comprising means coupled to said platform for reducing the area occupied by said platform to facilitate transport and storage of said apparatus.

11. The apparatus of claim 10 wherein said means for reducing the area occupied by said platform comprises folding means.

12. The apparatus of claim 10 wherein said surface is a translucent surface said translucency imparting a tactually soft appearance to said surface.

13. The apparatus of claim 10 wherein said translucent surface is colored light blue as a means for imparting a tactually soft appearance to said surface.

14. The apparatus of claim 10 wherein said translucent surface is colored off white as a means for imparting a tactually soft appearance to said surface.

15. The apparatus of claim 1 wherein said surface is a translucent surface said translucency imparting a tactually soft appearance to said surface.

16. The apparatus of claim 1 wherein said translucent surface is colored light blue as a means for imparting a tactually soft appearance to said surface.

17. The apparatus of claim 1 wherein said translucent surface is colored off white as a means for imparting a tactually soft appearance to said surface.

* * * * *